US010358264B1

(12) United States Patent
Bristol et al.

(10) Patent No.: US 10,358,264 B1
(45) Date of Patent: Jul. 23, 2019

(54) HANG TAG FOR THE DISPLAY OF BOXED ITEMS

(71) Applicant: FACEBOOK TECHNOLOGIES, LLC, Menlo Park, CA (US)

(72) Inventors: Peter Wesley Bristol, Seattle, WA (US); Scott Andrew Dallmeyer, Seattle, WA (US); Chun Li Chen, Seattle, WA (US)

(73) Assignee: Facebook Technologies, LLC, Menlo Park, CA (US)

( * ) Notice: Subject to any disclaimer, the term of this patent is extended or adjusted under 35 U.S.C. 154(b) by 51 days.

(21) Appl. No.: 15/597,059

(22) Filed: May 16, 2017

(51) Int. Cl.
*B65D 25/22* (2006.01)
*B65D 21/02* (2006.01)

(52) U.S. Cl.
CPC ..... *B65D 25/22* (2013.01); *B65D 21/0205* (2013.01)

(58) Field of Classification Search
CPC ..... B65D 25/00–22; B65D 21/00–0205
USPC ..... 220/751, 752–776; 206/279, 284, 285, 206/288, 289, 290
See application file for complete search history.

(56) References Cited

U.S. PATENT DOCUMENTS 3,417,861 A * 12/1968 Levy ..... B65D 25/22 206/45.28
3,493,154 A * 2/1970 Engle ..... B65D 25/22 294/150
3,695,418 A * 10/1972 Gwozdz ..... B65D 25/22 206/770
4,899,882 A * 2/1990 Benner ..... B65D 73/0064 206/459.5
6,142,364 A * 11/2000 Laker ..... B65D 5/062 229/125.42
6,375,239 B1 * 4/2002 Reed ..... B65D 5/4208 229/117.23
6,427,908 B1 * 8/2002 Laker ..... B65D 5/068 229/125.42
8,397,934 B2 * 3/2013 Lai ..... B65D 25/22 220/254.9
2004/0163989 A1 * 8/2004 Chandaria ..... B65D 73/0064 206/461
2010/0140267 A1 * 6/2010 Sellari ..... B65D 43/0241 220/270
2013/0186783 A1 * 7/2013 Glass ..... B42D 5/00 206/232

* cited by examiner

*Primary Examiner* — Kareen K Thomas
(74) *Attorney, Agent, or Firm* — FisherBroyles, LLP

(57) ABSTRACT

The disclosed apparatus may include a hang tag including a frame, a flap, and a strip. The frame may define an opening dimensioned to receive a display fixture and be secured to part of a package that is removable from a second part of the package. The flap may be coupled to the frame, and may fold over an edge of the frame to attach to the second part of the package, forming a seal between the two parts of the package. The strip may be disposed between, and removably coupled to, the flap and the frame. Removing the strip may break the seal between the two parts of the package, thereby enabling the parts of the package to be separated. Various other apparatuses, systems, and methods are also disclosed.

20 Claims, 8 Drawing Sheets

HANG TAG FOR THE DISPLAY OF BOXED ITEMS

BACKGROUND

Hang tags are a ubiquitous means for hanging products and product packaging on shelves, racks, and fixtures in commercial settings for display and sale. These tags are generally attached and/or incorporated into the product packaging, allowing the package to conveniently hang from rods or other similar fixtures.

Unfortunately, traditional hang tags often require specific product package architecture. For example, traditional hang tags may be integrated into a sealed plastic package, which may result in more plastic waste than is necessary and/or be unsightly to customers. In addition, packaging assemblies involving nested, separable boxes may rely on unappealing and/or cumbersome adhesives to prevent the package from falling apart.

SUMMARY

As will be described in greater detail below, the instant disclosure generally relates to a hang tag for the display of boxed items. In some embodiments, such a hang tag may include a frame that defines an opening dimensioned to receive a fixture for displaying a package. This frame may be secured to a first part of the package that is separable from a second part of the package. The hang tag may also include a flap coupled to the frame. This flap may be adapted to fold over an edge of the frame and through the opening, and attach to the second part of the package. Attaching the flap to the second part of the package may form a seal between the first and second parts of the package. The hang tag may additionally include a strip disposed between, and removably coupled to, the flap and the frame such that the seal between the first and second parts of the package is broken when the strip is removed, thereby enabling the first and second parts of the package to be separated.

The frame of the hang tag may take a variety of shapes. For example, the frame may form a substantially triangular shape with a vertex of the triangular shape being at the topmost portion of the frame, a substantially ovoid shape, a substantially square shape, and/or a hooked shape.

The hang tag may be secured to the package in a variety of ways. For example, the hang tag may include a first adhesive portion that secures the frame to the first part of the package, and a second adhesive portion that secures the flap to the second part of the package. These adhesive portions may be protected against accidental use. For example, the hang tag may also include removable protective barriers that are applied to the first adhesive portion and the second adhesive portion to prevent the first and second adhesive portions from prematurely adhering to unintended surfaces. Furthermore, these adhesive portions may include a variety of adhesives, such as styrenic glues, acylates, cyanoacrylates, methacrylates, epoxies, and/or any other suitable form of adhesive.

The components of the hang tag may be manufactured in a variety of ways. In some embodiments, the frame, the flap, and the strip may be cut out of and/or processed from a single uniform sheet of material. The components of the hang tag may also exhibit a variety of features. For example, the strip may include a visual indicator indicating the direction in which a customer or end user should pull the strip in order to remove the strip.

Additionally, the hang tag may be manufactured out of a variety of materials. For example, the hang tag may be manufactured out of plastic materials, metallic materials, paper-based materials, laminate materials, and/or any other suitable materials for manufacturing a hang tag. These materials may exhibit a variety of properties. For example, the hang tag may include transparent materials, translucent materials, opaque materials, and/or colored materials.

Moreover, an end user or customer may, as part of using the hang tag, transform the hang tag. For example, removing the strip from the hang tag may transform the frame into a pull tab that facilitates removal of the first part of the package from the second part of the package.

In some embodiments, the hang tag may be included in a package assembly. Such a package assembly may include a package that includes at least a first and second part. The first part of the package may be separable from the second part of the package. The package assembly may further include a hang tag. This hang tag may, as described above, include a frame that defines an opening dimensioned to receive a fixture for displaying the package. This frame may be secured to the first part of the package. The hang tag may also include a flap that is coupled to the frame. The flap may be adapted to fold over an edge of the frame and through the opening. The flap may then attach to the second part of the package, thereby forming a seal between the first and second parts of the package. The hang tag may further include a strip that is disposed between, and removably coupled to, the flap and the frame such that the seal between the first and second parts of the package is broken when the strip is removed, thereby enabling the first and second parts of the package to be separated. The hang tag included in the package assembly may exhibit any or all of the features described above.

The package may exhibit a variety of properties. For example, the first part of the package may be dimensioned to be removably inserted into a space defined by the sides of the second part of the package. Furthermore, the first and second parts of the package may be dimensioned to enclose a merchandise item.

A method for using a hang tag may include fastening a frame of the hang tag to a first part of a package. The frame may define an opening dimensioned to receive a fixture for displaying the package. The first part of the package may then be inserted into a space defined by the sides and bottom of a second part of the package. The method may further include folding a flap of the hang tag over an edge of the frame and through the opening, and fastening the flap to the second part of the package. Fastening the flap in this manner may form a seal between the first and second parts of the package.

In some examples, the frame of the hang tag may include a first adhesive portion, and the flap of the hang tag may include a second adhesive portion. In these examples, fastening the frame to the first part of the package may include exposing the first adhesive portion to the first part of the package, thereby forming a seal between the frame and the first part of the package. These examples may also include fastening the flap to the second part of the package by exposing the second adhesive portion to the second part of the package, thereby forming a seal between the flap and the second part of the package.

In some embodiments, the hang tag may optionally include protective barriers coupled to the first and second adhesive portions that prevent the first and second adhesive portions from prematurely adhering to unintended surfaces. In these embodiments, fastening the frame to the first part of the package may include removing the protective barrier from the first adhesive portion prior to exposing the first adhesive portion to the first part of the package. Likewise, fastening the flap to the second part of the package may include removing the protective barrier from the second adhesive portion prior to exposing the second adhesive portion to the second part of the package.

Moreover, the hang tag may be manufactured using a variety of techniques. For example, manufacturing the precursor hang tag may include die-cutting, molding, thermoforming, extruding, laser-cutting, positive-space printing, lamination, or any other suitable technique or combination of techniques for manufacturing the hang tag.

Features from any of the above-mentioned embodiments may be used in combination with one another in accordance with the general principles described herein. These and other embodiments, features, and advantages will be more fully understood upon reading the following detailed description in conjunction with the accompanying drawings and claims.

BRIEF DESCRIPTION OF THE DRAWINGS

The accompanying drawings illustrate examples of various embodiments described herein. These drawings are a part of the specification and, together with the following description, demonstrate and explain various principles of the instant disclosure. Throughout the drawings, identical reference characters and descriptions indicate similar, but not necessarily identical, elements.

Figure 1:
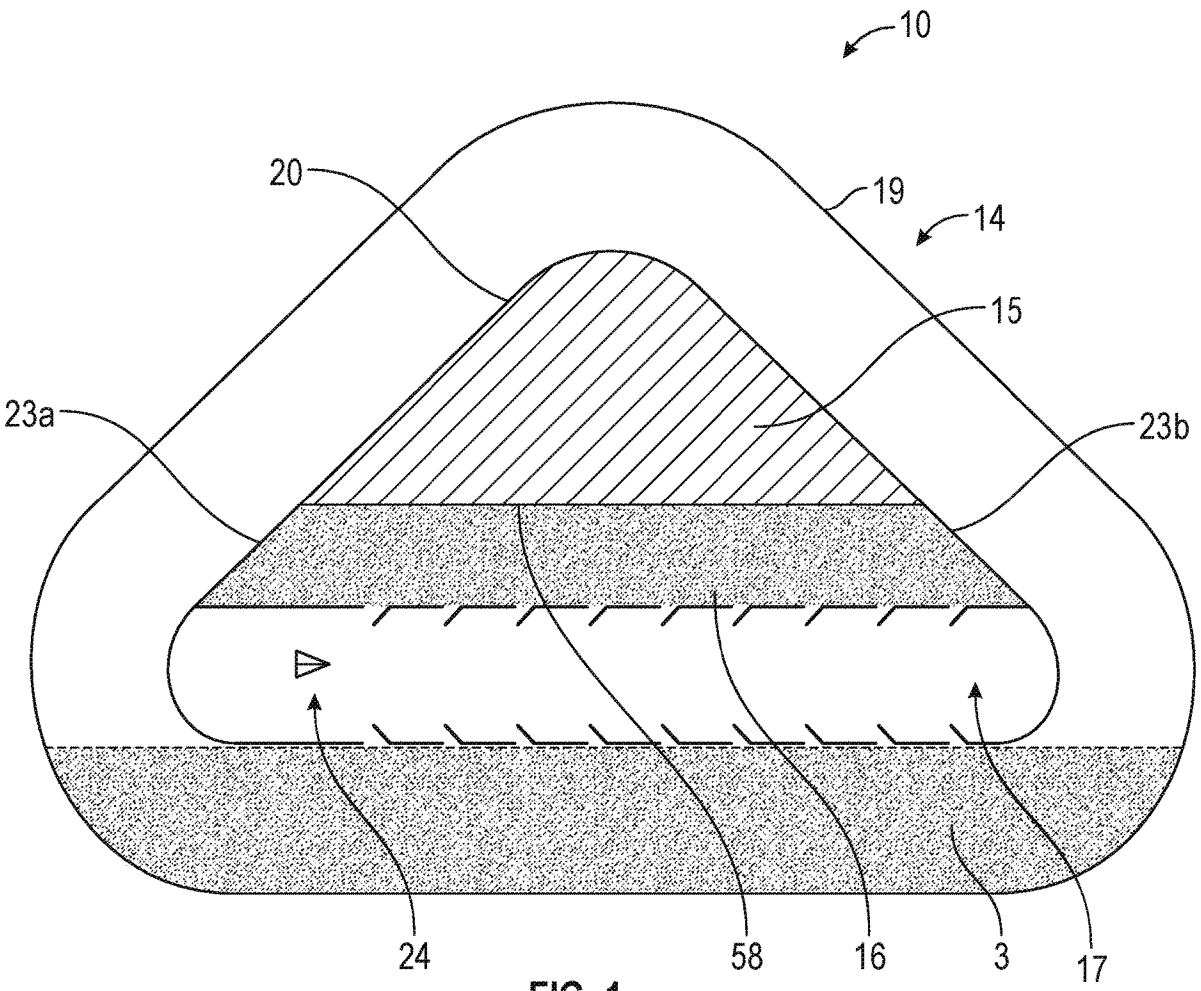
FIG. 1 is a plan view of an example hang tag prior to fastening the hang tag to a package.

While the example embodiments described herein are susceptible to various modifications and alternative forms, specific embodiments have been shown by way of example in the drawings and will be described in detail herein. However, the elements, configurations, and steps shown in the drawings are not intended to be limited to the particular forms disclosed. Rather, the instant disclosure covers all modifications, equivalents, and alternatives falling within the scope of the appended claims.

DETAILED DESCRIPTION OF EXAMPLE EMBODIMENTS

The present disclosure describes a hang tag that may be used to simultaneously provide a tamper-resistant seal for a package as well as a convenient means of displaying the package on a display fixture. Such a hang tag may also enable users to easily separate nested portions of the package by using a portion of the hang tag as a pull tab. As will be explained in greater detail below, embodiments of the instant disclosure may provide a simple, easy-to-use hang tag that also provides a number of improvements over traditional packaging methods. By incorporating a tamper-evident sealing component, the hang tag disclosed herein may allow merchandise providers to package items in aesthetically pleasing packaging without compromising on foiling would-be thieves. Moreover, the architecture of the hang tag may provide customers with an easy means of opening sealed packages by incorporating a tear-away strip, as will be described in greater detail below. This tear away strip may further improve the functioning of packaging that incorporates the hang tag by transforming the frame of the hang tag into a pull tab that facilitates easy separation of nested packaging components.

The following will provide, with reference to FIG. 1, examples of a hang tag. The following will also provide, with reference to FIGS. 2-7, examples of package assemblies incorporating a hang tag, as well as illustrate an example method of affixing the hang tag to specific portions of a package. An example method for fastening and separating a hang tag frame, flap, and strip will be provided in connection with FIG. 8.

FIG. 1 is a plan view of an example hang tag. A hang tag in the configuration illustrated in FIG. 1 may sometimes be referred to as a precursor hang tag, and this precursor hang tag may be modified when being attached to a package assembly, as will be described in greater detail below. As shown in FIG. 1, a hang tag 10 may include a frame 14, defined by an outer edge 19 and an inner edge 20. Frame 14 may define, by inner edge 20, an opening 15 that is dimensioned to receive a fixture for displaying a package assembly. Hang tag 10 may additionally include a flap 16 defined by flap edges 23*a* and 23*b*, as well as flap edge 58. Flap edges 23*a* and 23*b* may be separable from or otherwise disconnected from frame 14 such that flap 16 may be folded over an edge of frame 14, as will be described in greater detail below. Flap 16 may be removably coupled to frame 14 by a strip 17. Strip 17 may be disposed between and removably coupled to both flap 16 and frame 14, and removal of strip 17 may break the coupling between frame 14 and flap 16, allowing frame 14 and flap 16 to be separated from each other.

Hang tag 10 may additionally include adhesive portions that facilitate attaching hang tag 10 to a package assembly. For example, hang tag 10 may include adhesives on a lower portion of hang tag 10, illustrated as adhesive portion 3. Adhesive portion 3 may secure frame 14 (and thereby hang tag 10) to a first part of the package assembly. Hang tag 10 may further include an adhesive portion on flap 16 that secures flap 16 to a second part of the package assembly. These adhesive portions may include a variety of adhesives, such as styrenic glues, acylates, cyanoacrylates, methacrylates, epoxies, various cements, and/or any other adhesive materials or glues of suitable strength and binding properties for hanging and/or sealing a package assembly. The adhesive portions may be applied to frame 14 and flap 16 in a variety of ways, including layering or topical application to the surface of the material, use of co-extrusion techniques, or any other technique or combination of techniques for forming and/or combining adhesive films and plastic materials.

As illustrated in FIG. 1, strip 17 may optionally include an indicator 24 that appears on strip 17 to indicate the direction in which an end user should pull strip 17 to remove strip 17. Indicator 24 may be applied to strip 17 in a variety of ways. In some examples, indicator 24 may be etched, engraved, and/or embossed into the material of strip 17. Additionally or alternatively, indicator 24 may be printed, painted, or otherwise illustrated on strip 17 using inks, dyes, paints, or any other suitable marking agent. In further embodiments, indicator 24 may be a separate piece of material affixed to, laminated on, or co-extruded with strip 17.

As illustrated in FIG. 1, frame 14 may form a substantially triangular shape with a vertex of the triangular shape being at the topmost portion of the frame. However, frame 14 may take a variety of other shapes, including but not limited to, a substantially ovoid shape, a substantially square shape, and/or a hooked shape. In general, the shape of frame 14 may, regardless of the exact nature of the shape, define opening 15 by inner edge 20, with opening 15 being dimensioned to receive a display fixture. Frame 14 may also vary in width, thickness, and other dimensions, depending on the materials and/or application in which hang tag 10 is applied. In some examples, frame 14 may be flat, with substantial (e.g., ½ inch) distance between inner edge 20 and outer edge 19. As an additional example, frame 14 may be substantially cylindrical (e.g., as a wire or bent rod). These examples are merely provided for sake of illustration, and should not be considered limiting in nature. Frame 14 may take any suitable shape, thickness, or other dimension that defines opening 15 such that opening 15 may accommodate a display fixture.

Additionally, hang tag 10 may be manufactured out of a variety of materials. For example, hang tag 10 may be manufactured out of plastic materials, metallic materials, paper-based materials, laminate materials, and/or any other suitable materials for manufacturing a hang tag. These materials may exhibit a variety of properties. For example, the hang tag may include transparent materials, translucent materials, opaque materials, and/or colored materials. The materials that make up hang tag 10 may also be of any suitable thickness to ensure that the composition of hang tag 10 is sufficient to suspend a package and its contents from a hanging fixture, such as a rod or hook, and maintain a seal between parts of a package for significant lengths of time. Notably, hang tag 10 may suspend the package and maintain the seal for a period of time that makes up the packaged product's marketing cycle. As an example, hang tag 10 may be formed of a durable, transparent plastic material having a thickness of approximately 0.25 mm.

Hang tag 10 may be manufactured using a variety of techniques. For example, manufacturing the precursor hang tag may include die-cutting, molding, thermoforming, extruding, laser-cutting, positive-space printing, and/or lamination of the materials that compose hang tag 10. In some embodiments, frame 14, flap 16, and strip 17 may be cut out of or otherwise processed from a uniform sheet of material, such as a plastic sheet, using any suitable combination of the aforementioned techniques.

In one embodiment, hang tag 10 may be manufactured as a precursor hang tag for subsequent formation of hang tag 10. As shown in FIG. 1, the die or other processing of a plastic sheet may form a basic structure of frame 14 that includes outer edge 19 and inner edge 20 joined to material occupying opening 15. In this example, this material may occupy the space that later includes opening 15 and, when removed, provides inner edge 20 of frame 14. In addition, inner edge 20 may also be removably joined to flap edges 23*a* and 23*b* of flap 16. The bottom edge of the material occupying opening 15 may also be removably joined to flap edge 58 of flap 16 so that flap 16 may be folded over inner edge 20 and through opening 15, as described above and as shown in FIG. 2. After removal to form opening 15, the material occupying that space may be discarded.

Figure 2:
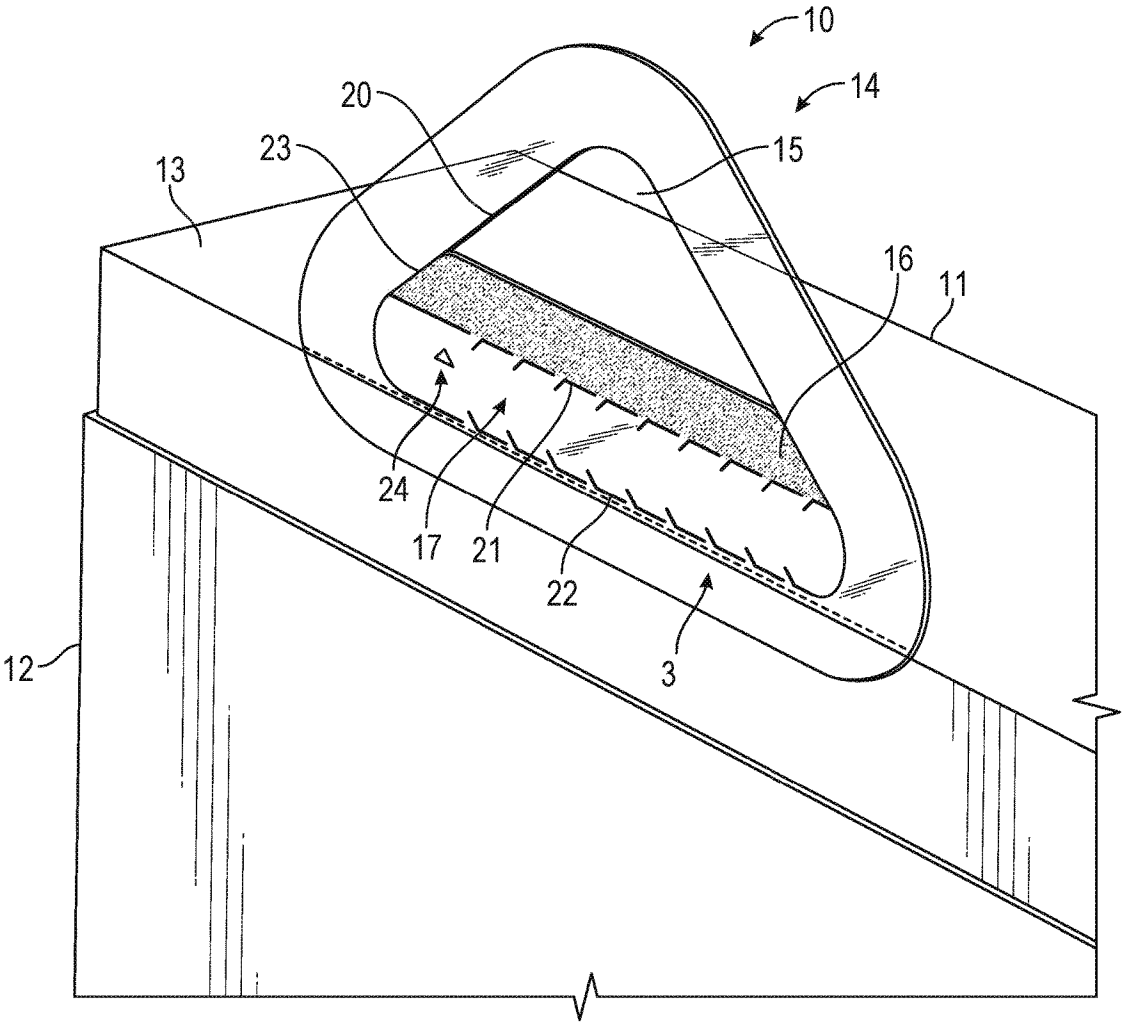
FIG. 2 is a perspective view of an example package assembly in which the example hang tag of FIG. 1 is secured to a first part of the package assembly that is separable from a second part of the package assembly.

FIG. 2 a perspective diagram of an example package assembly in which the example hang tag of FIG. 1 is secured to a first part of a package assembly that is separable from a second part of the package assembly. A package assembly 11 may include a package made up of at least two parts, illustrated as inner package 13 and outer package 12. Package assembly 11, and by extension inner package 13 and outer package 12, may be dimensioned to enclose a merchandise item (not illustrated). Inner package 13 and outer package 12 may be arranged in a variety of ways. In some examples, outer package 12 may serve as a wrapper or sleeve for inner package 13. In other words, inner package 13 may be dimensioned to be removably inserted into a space defined by the sides of outer package 12. Outer package 12 may also include various buffer spaces, supports, padding, and/or other features that protect inner package 13 and/or the contents of package assembly 11.

Hang tag 10 may be affixed to inner package 13 by fastening part of frame 14 to inner package 13. In the example of the substantially triangular hang tag illustrated in FIG. 2, adhesive portion 3 of frame 4 may be adhered to a surface of inner package 13. Frame 14 may be fastened to an exterior surface of inner package 13, as illustrated in FIG. 2, such that the material of frame 14 will reside between inner package 13 and outer package 12 when inner package 13 is removably inserted into outer package 12. Alternatively, frame 14 may be fastened to an inner surface of inner package 13 and protrude through the upper surface of inner package 13 such that flap 16 is able to be folded over the sides of inner package 13 and outer package 12, as will be discussed in greater detail below.

Hang tag 10 may include visual indicators to assist in proper alignment and fastening of hang tag 10 to inner package 13. For example, strip 17 may be defined by perforations 21 and 22. In some embodiments, perforations 21 may denote the boundary between strip 17 and flap 16. Similarly, perforations 22 may denote the boundary between strip 17 and frame 14. though any suitable amount of material may exist between perforations 22 and frame 14 in order to ensure that frame 14 is properly fastened to inner package 13.

Although the examples described herein describe the use of adhesives to secure frame 14 to inner package 13, any suitable fastening method may be used, including but not limited to rivets, staples, crimping mechanisms, pins, clips, clamps, snaps, tailored stitches, and the like.

Figure 3:
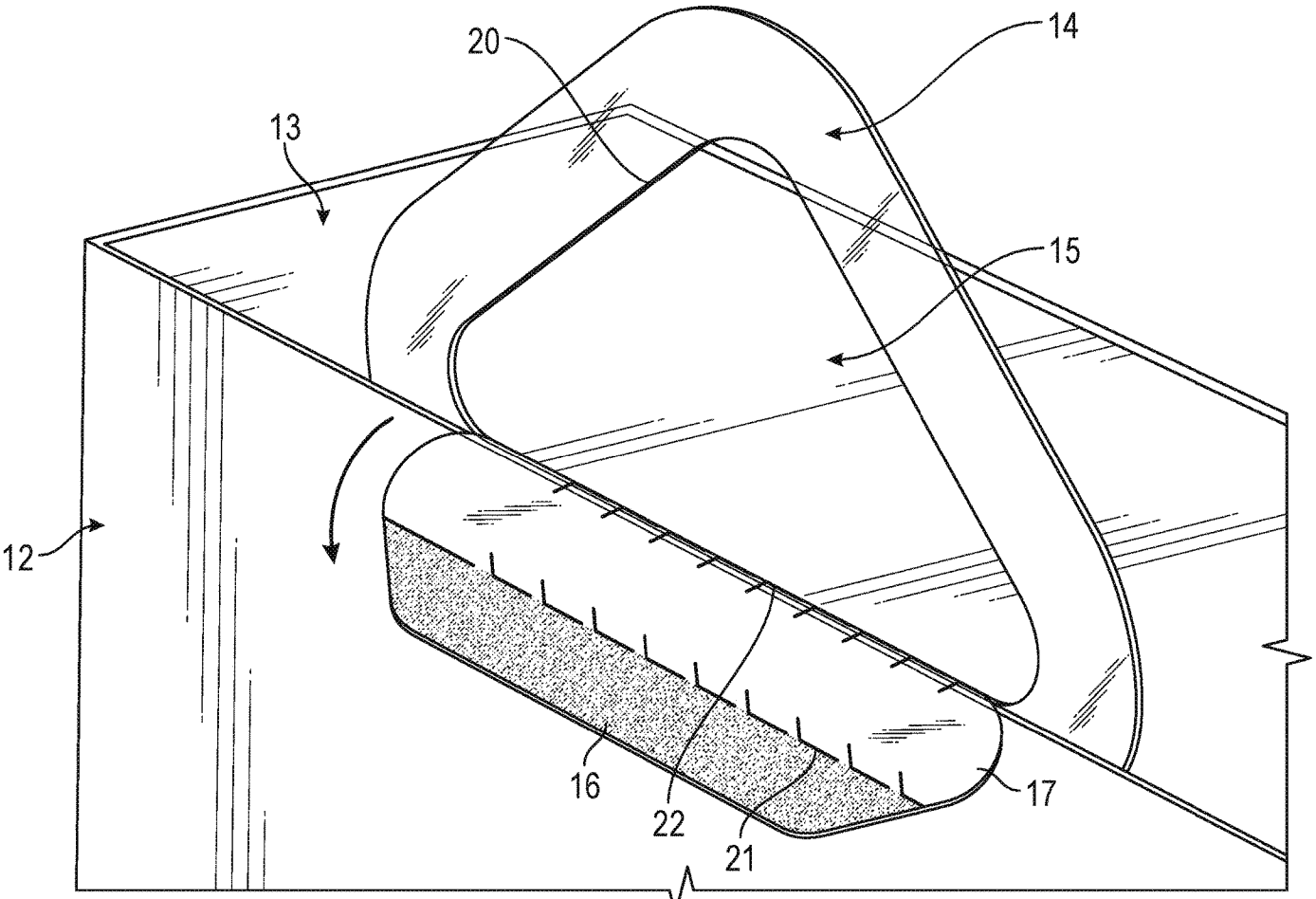
FIG. 3 is a perspective view of the example package assembly of FIG. 2 in which flap and strip segments of the hang tag fold over an edge of a frame toward an outer surface of the second part of the package.

Regardless of the methods used to affix hang tag 10 to inner package 13, frame 14, flap 16, and strip 17 may be positioned such that flap 16 and strip 17 are able to be folded over an edge of frame 14 to affix to an outer surface of outer package 12. FIG. 3 is a perspective view of the example package assembly of FIG. 2 in which flap 16 and strip 17 are folded over an edge of frame 14 toward an outer surface of outer package 12.

As described above, hang tag 10 may be affixed to inner package 13, and inner package 13 may then be inserted into a space defined by the sides and bottom of outer package 12. As shown in FIG. 3, the upper surface of inner package 13 may be flush with an upper edge of outer package 12 once inner package 13 is fully inserted into the space defined by outer package 12. Frame 14 of hang tag 10 may protrude above the upper surface of inner package 13 such that opening 15 is exposed and able to receive a fixture for displaying the complete package assembly.

Furthermore, flap 16 and strip 17 may protrude past the upper surface of inner package 13 and/or outer package 12. In some embodiments and as illustrated in FIG. 3, perforations 22 may be flush with the upper edge of outer package 12. Alternatively, a portion of frame 14 or other material may protrude above the upper edge of outer package 12, causing perforations 22 to be raised above the upper edge of outer package 12. Flap 16 and strip 17 may then fold over an edge of frame 14 towards an outer surface of outer package 12. As illustrated in the example of FIG. 3, perforations 22 may serve as a boundary of strip 17 in addition to being an inflection point along which flap 16 and strip 17 are folded over the edge of frame 14. Once flap 16 and strip 17 have been folded over the edge of frame 14, flap 16 may be adhered or otherwise fastened to outer package 12.

Figure 4:
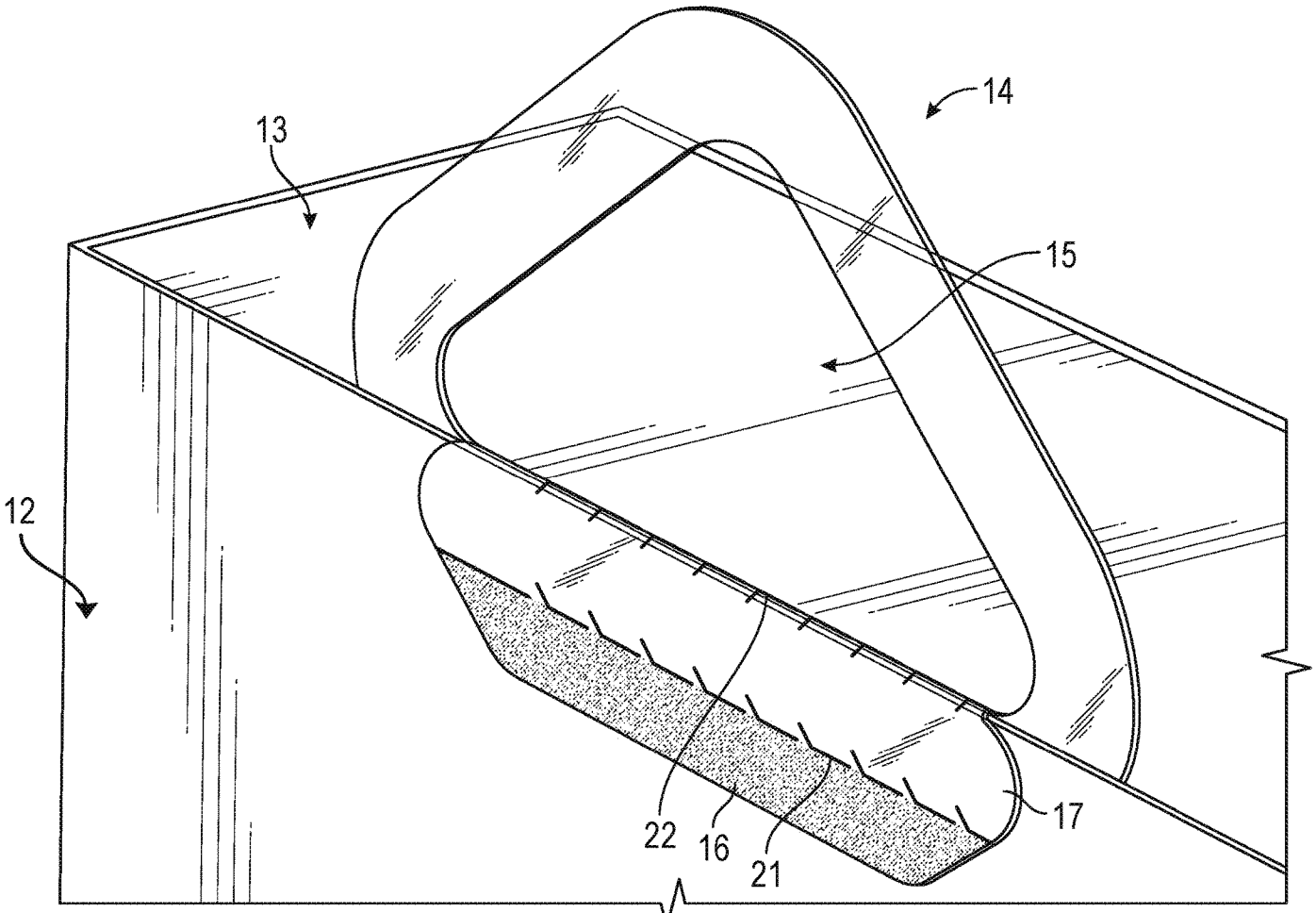
FIG. 4 is a perspective view of the example package assembly of FIG. 2 in which the flap is secured to the second part of the package.

FIG. 4 is a perspective view of the example package assembly in which flap 16 has been secured to a portion of outer package 12, thus forming a seal between inner package 13 and outer package 12. As shown, flap 16 has been folded over the edge of frame 14 to make contact with an outer surface of outer package 12. In embodiments that use adhesives to secure flap 16 to outer package 12, pressure may be applied to flap 16 to facilitate the bonding of flap 16 to outer package 12. In embodiments that utilize fasteners or other methods of securing flap 16, those methods may be executed here to secure flap 16 to outer package 12. For example, outer package 12 may include a slot, and flap 16 may tuck into that slot.

Upon completion of fastening flap 16 to outer package 12, flap 16 and strip 17 may be secured such that strip 17 is flush with the outer surface of outer package 12 and exposed to customers or other individuals who wish to open the package. Frame 14 may define opening 15, and opening 15 may no longer enclose flap 16 or strip 17. Frame 14 and/or flap 16 may be secured to inner package 13 and outer package 12 such that perforations 21 and 22 are also exposed, thereby facilitating removal of strip 17 and thereby the opening of the package assembly, as will be described further below.

With the package assembly in the configuration shown in FIG. 4, retailers or other merchants who wish to display the package assembly may hang the package assembly from a display fixture by placing frame 14 over a display fixture such that the fixture protrudes through opening 15. Furthermore, this configuration of the package assembly may provide a tamper-resistant seal between inner package 13 and outer package 12, thereby protecting the contents of the package assembly from malicious individuals. As described above, frame 14 and/or flap 16 may be fastened, adhered, or otherwise coupled to inner package 13, outer package 12, and/or other components of the package assembly. Premature removal of components of hang tag 10 may cause irreversible visible changes to hang tag 10 and/or portions of the package assembly. For example, forced removal of frame 14 from inner package 13 or removal of flap 16 from outer package 12 may cause visible changes, such as surface scarring, to the surfaces of the respective package components. As an additional example, removal of strip 17 may cause parts of perforations 21 and/or 22 to change in texture and/or color, as may happen with distressed plastics. Individuals may also find it difficult to re-attach strip 17 to hang tag 10 without causing visible signs of tampering.

Figure 5:
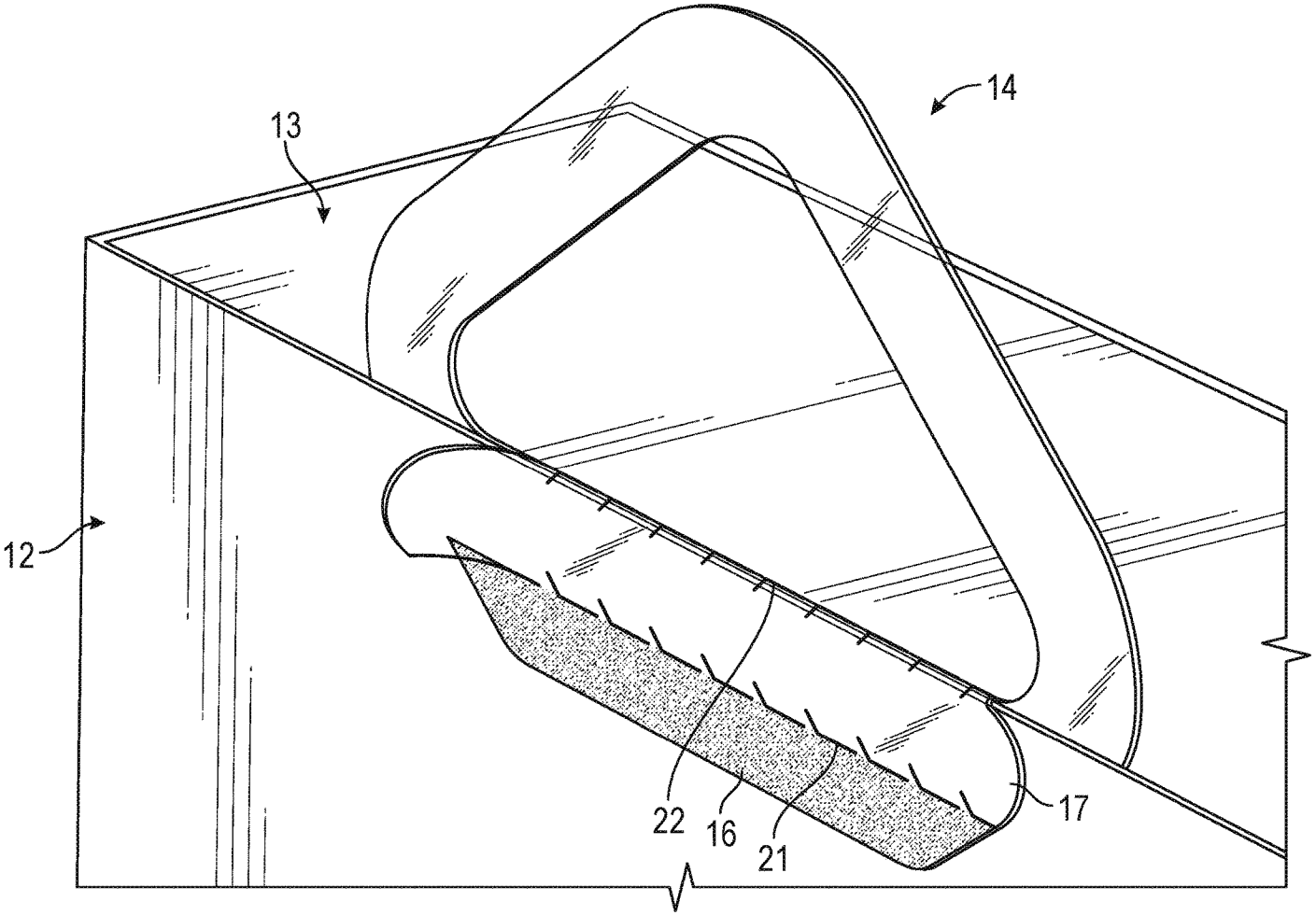
FIG. 5 is a perspective view of the example package assembly of FIG. 2 in which the strip segment is torn away to break a seal created between the package parts.

Removing strip 17 from the package assembly may break the coupling between flap 16 and frame 14, and thereby break the seal between inner package 13 and outer package 12. FIG. 5 is a perspective view of strip 17 in the process of being torn away to break the coupling between frame 14 and flap 16. As described above, frame 14 has been fastened to inner package 13, and flap 16 has been fastened to outer package 12. As long as strip 17 remains coupled to frame 14 and flap 16, hang tag 10 may function as a tamper-resistant seal between these two package parts. A customer or other individual may break this seal by removing strip 17. As shown in FIG. 5, an individual may remove strip 17 by lifting one edge of strip 17 and pulling that edge along an axis of strip 17, thereby breaking perforations 21 and 22 and allowing strip 17 to be removed and discarded. Although not illustrated in FIG. 5, strip 17 may optionally include indicator 24 that indicates the direction in which an individual may pull strip 17 to remove strip 17 from the package assembly, as described in connection with FIG. 1. In some embodiments, perforations may be directional; that is, arranged in such a way as to facilitate easy removal when strip 17 is pulled in a particular direction. This direction may be shown by indicator 24.

Furthermore, strip 17 may include a variety of other features to facilitate removal of strip 17. For example, a portion of strip 17 may be bent, folded, raised, curved, textured, or otherwise engineered to aid customers in grabbing and pulling strip 17. These features may be accomplished through any technique or combination of techniques that may be used as part of manufacturing hang tag 10, as described in greater detail both above and below.

Figure 6:
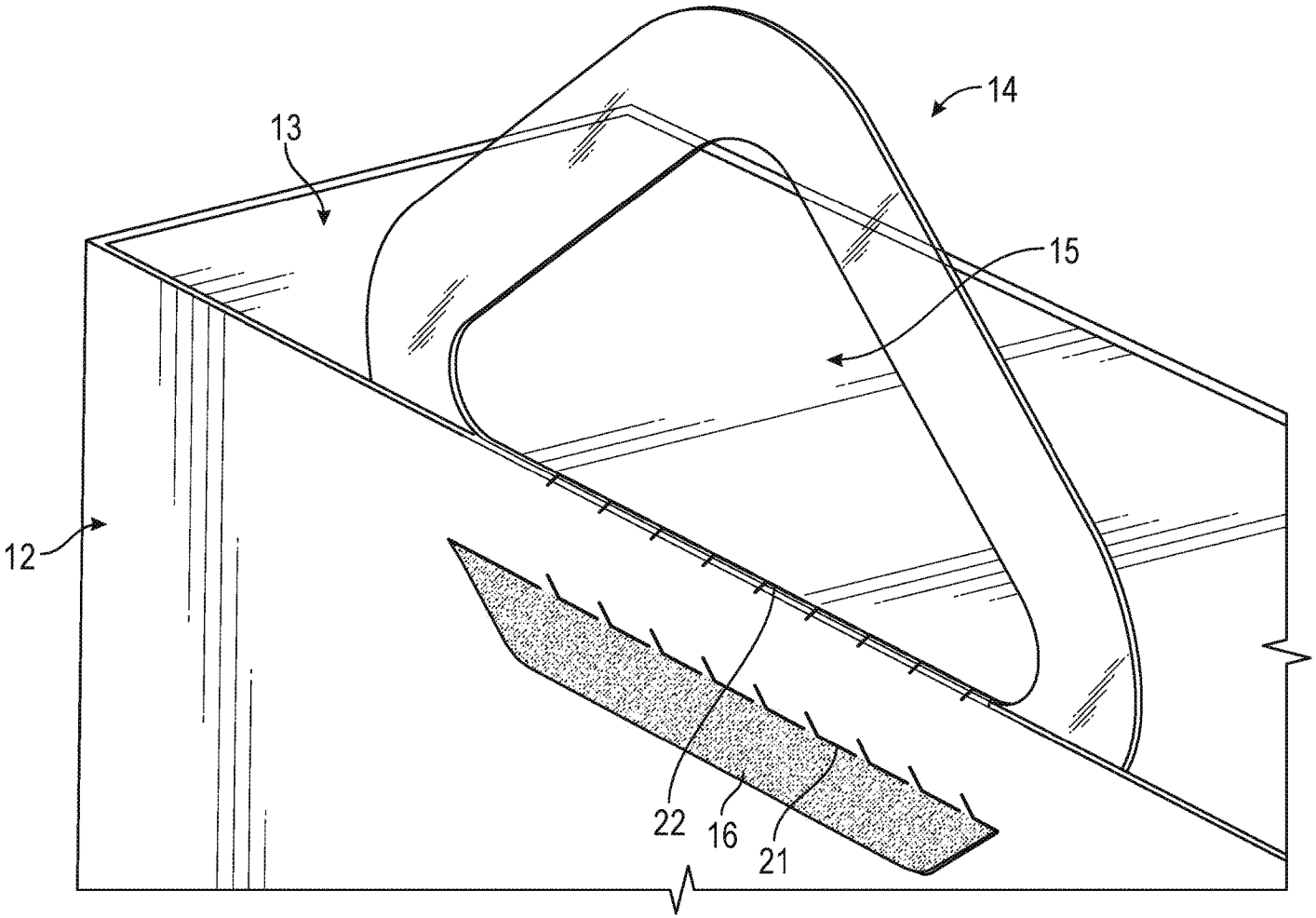
FIG. 6 is a perspective view of the example package assembly of FIG. 2 in which the strip segment has been completely removed to break the seal between the package parts.

Once strip 17 has been removed, hang tag 10 may no longer form a seal between inner package 13 and outer package 12, thus allowing inner package 13 to be separated from outer package 12. FIG. 6 is a perspective view of hang tag 10 and the package assembly after strip 17 has been removed and discarded.

As shown in FIG. 6, frame 14 and flap 16, while still fastened to inner package 13 and outer package 12 respectively, are no longer coupled together once strip 17 (not illustrated in FIG. 6) has been removed. Customers or other individuals may then separate inner package 13 from outer package 12. Furthermore, removal of strip 17 may transform frame 14 into a pull tab that facilitates the removal of inner package 13 from outer package 12. Note that a portion of frame 14 remains fastened to inner package 13, but, with the removal of strip 17, frame 14 is no longer coupled to outer package 12. A user may thus be able to use frame 14 as a pull tab or handle, thereby improving the user's ability to remove inner package 13 from outer package 12.

Evidence of the removal of strip 17 may remain on the package assembly. For example, removing strip 17 from hang tag 10 may cause permanent damage to perforations 21 and 22. Specifically, the material in those areas may be deformed, discolored, and/or otherwise visibly altered by the removal of strip 17. In some embodiments, other features may provide evidence that strip 17 has been removed and/or that the seal formed by hang tag 10 has been disrupted. For example, a weak adhesive may be applied to the side of strip 17 that is proximal to outer package 12. This weak adhesive may not substantially hinder removal of strip 17, but may nevertheless provide further evidence of the removal of strip 17 in the form of damage to the surface of outer package 12.

Figure 7:
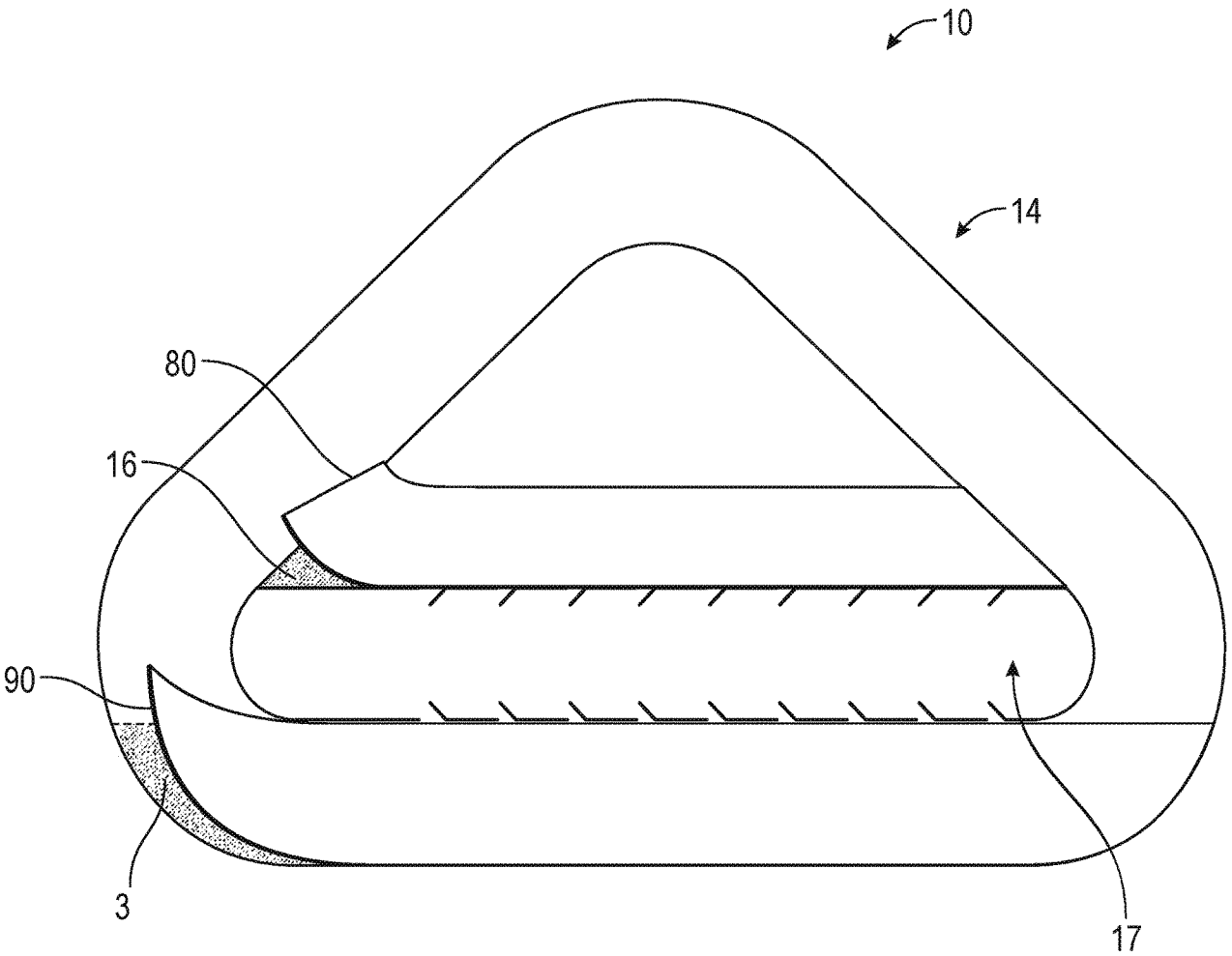
FIG. 7 is a schematic diagram showing removable protective barriers covering adhesive sections of an example precursor hang tag.

Prior to being fastened to the package assembly, a precursor form of hang tag 10 may include optional features to facilitate proper coupling of hang tag 10 to various components of the package assembly. FIG. 7 is a schematic diagram of hang tag 10 in a precursor state showing protective barriers covering adhesive sections of hang tag 10.

As explained above, hang tag 10 may, in some embodiments, include adhesive portions on various parts of hang tag 10 to facilitate fastening hang tag 10 to a package assembly. For example, flap 16 and frame 14 may have adhesive portions that adhere frame 14 and flap 16 to various portions of the package assembly, as described above. In some embodiments, the precursor form of hang tag 10 may also include removable protective barriers applied to the adhesive portions to prevent those adhesive portions from prematurely adhering to unintended surfaces. As illustrated in FIG. 7, an adhesive portion of flap 16 may initially be covered by a protective barrier 80, and adhesive portion 3 of frame 14 may initially be covered by a protective barrier 90. These protective barriers may be designed to peel away from or otherwise be removed from the adhesive portions, thereby exposing the adhesive portions for fastening to inner package 13, outer package 12, or any other suitable part of a package assembly. In some examples, protective barriers 80 and 90 may be dimensioned to cover essentially just the adhesive portions of hang tag 10. Alternatively, protective barriers 80 and 90 may exist as a single barrier (as opposed to the two separate entities illustrated in FIG. 7) that covers multiple adhesive surfaces of hang tag 10.

Protective barriers 80 and 90 may be made out of a variety of materials, such as thin-film laminates, plastics, papers, waxes, or any other materials or combination of materials suitable for removably protecting an adhesive portion of hang tag 10. Furthermore, protective barriers 80 and 90 may include flaps, crimps, folds, or other features designed to assist end-users in removing the protective barrier from the adhesive layer. Protective barriers 80 and 90 may optionally include visual or textured indicators that indicate a direction in which an individual should pull the protective barrier in order to expose the adhesive portion. These visual indicators may be printed, embossed, dyed, or otherwise affixed to protective barriers 80 and 90 such that they are visible to an individual in possession of hang tag 10.

Figure 8:
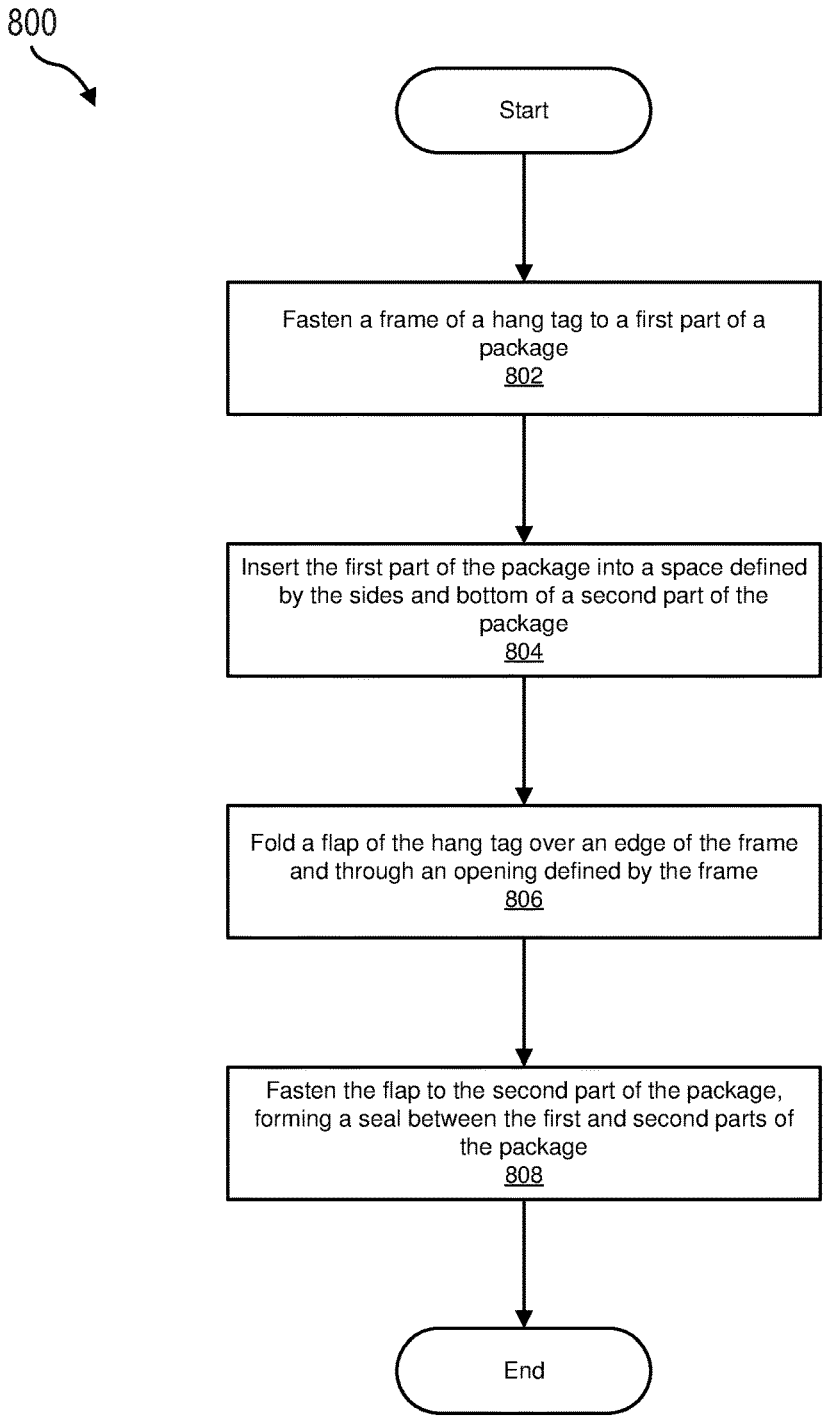
FIG. 8 is a flow diagram of an example method utilizing the hang tag of FIG. 1.

An example method for utilizing the above-described hang tag is provided in connection with example method 800, illustrated in FIG. 8. At step 802 in FIG. 8, a hang tag may be affixed to a first part of a package. At step 804 in FIG. 8, example method 800 may include inserting the first part of the package into a space defined by the sides and bottom of a second part of the package. At step 806, example method 800 may include folding the flap over an edge of the frame and through the opening defined by the frame. Finally, at step 808, example method 800 may include fastening the flap to the second part of the package, thereby forming a seal between the first and second parts of the package and completing construction of the package assembly.

In some examples, the hang tag described in FIG. 8 may include a first adhesive portion coupled to the frame and a second adhesive portion coupled to the flap. These adhesive portions may be coupled to the frame and flap by topical application of the first and second adhesive portions, co-extruding the first and second adhesive portions with the frame and the flap, and/or any other suitable method of coupling adhesives to a surface. In these examples, fastening the frame to the first part of the package at step 802 may include exposing the first adhesive portion to the first part of the package (e.g., by removing any applicable protective coverings or barriers applied during the manufacture of the hang tag and pressing the frame against a surface of the package), thereby forming a seal between the frame and the first part of the package. Similarly, fastening the flap to the second part of the package at step 808 may include exposing the second adhesive portion to the second part of the package, thereby forming a seal between the flap and the second part of the package. Note that in this configuration, the frame and the flap are coupled by the strip, thus also forming a seal between the first and second parts of the package until the strip is removed, as described in greater detail above.

Some packages may be dimensioned and/or contain merchandise of enough weight such that retailers and/or other end users may find it advantageous to use multiple hang tags in a single package assembly. These package assemblies may include multiple instances of the hang tag, each of which may be fastened to the package assembly by repeating the steps of example method 800 for each hang tag applied to the package. These steps may be performed in series or in parallel, depending on the context in which the hang tags are applied. Furthermore, the hang tags may be arranged on the package side-by-side or in any other suitable arrangement for the display of a bulky or heavy package. Packages that include more than one hang tag may be displayed on multi-rod fixtures.

While the foregoing disclosure sets forth various embodiments using specific block diagrams, flowcharts, and examples, each block diagram component, flowchart step, operation, and/or component described and/or illustrated herein may be implemented, individually and/or collectively, using a wide range of hardware, software, or firmware (or any combination thereof) configurations. In addition, any disclosure of components contained within other components should be considered as examples in nature since many other architectures can be implemented to achieve the same functionality.

The process parameters and sequence of the steps described and/or illustrated herein are given by way of example only and can be varied as desired. For example, while the steps illustrated and/or described herein may be shown or discussed in a particular order, these steps do not necessarily need to be performed in the order illustrated or discussed. The various methods described and/or illustrated herein may also omit one or more of the steps described or illustrated herein or include additional steps in addition to those disclosed.

The foregoing description, for purposes of explanation, has been described with reference to specific embodiments and has been provided to enable others skilled in the art to best utilize various aspects of the example embodiments disclosed herein. However, the illustrative discussions above are not intended to be exhaustive or to limit the scope of the claims to the precise forms disclosed. Many modifications and variations are possible in view of the above teachings without departing from the spirit and scope of the instant disclosure. The instant disclosure covers all modifications, equivalents, and alternatives falling within the scope of the appended claims. Features from any of the above-mentioned embodiments may be used in combination with one another in accordance with the general principles described herein. The embodiments were chosen to best explain the principles underlying the claims and their practical applications, thereby enabling others skilled in the art to best use the embodiments with various modifications as are suited to the particular uses contemplated. The embodiments disclosed herein should be considered in all respects illustrative and not restrictive. Reference should be made to the appended claims and their equivalents in determining the scope of the instant disclosure.

The terminology used in the description of the various embodiments described herein is for the purpose of explaining particular embodiments only and is not intended to be limiting. As used in the discussion of the various highlighted embodiments and the appended claims, the singular forms "a," "an," and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, integers, steps, operations, elements, and/or components but do not preclude the presence or addition of one or more other features, integers, steps, operations, elements, components, and/or groups thereof. The term "exemplary" is used herein in the sense of "serving as an example, instance, or illustration" and not in the sense of "representing the best of its kind." Unless otherwise noted, the terms "connected to," "coupled to," and "attached to" (and their derivatives), as used in the specification and claims, are to be construed as permitting both direct and indirect (i.e., via other elements or components) connection.

What is claimed is:

1. A hang tag comprising:
- a frame defining an opening dimensioned to receive a fixture for displaying a package, the frame being secured to a first part of the package that is separable from a second part of the package;
- a flap coupled to the frame, wherein the flap:
  - is adapted to fold over an edge of the frame and through the opening; and
  - attaches to the second part of the package, thereby forming a seal between the first part of the package and the second part of the package; and
- a strip disposed between, and removably coupled to, the flap and the frame, wherein the seal between the first and second parts of the package is broken when the strip is removed, thereby enabling the first and second parts of the package to be separated.

2. The hang tag of claim 1, wherein removal of the strip transforms the frame into a pull tab that facilitates removal of the first part of the package from the second part of the package.

3. The hang tag of claim 1, further comprising a first adhesive portion that secures the frame to the first part of the package and a second adhesive portion that secures the flap to the second part of the package.

4. The hang tag of claim 3, further comprising removable protective barriers applied to the first adhesive portion and the second adhesive portion that prevent the first and second adhesive portions from prematurely adhering to unintended surfaces.

5. The hang tag of claim 3, wherein the first adhesive portion and the second adhesive portion each comprise at least one of:
- a styrenic glue;
- an acylate;
- a cyanoacrylate;
- a methacrylate; or
- an epoxy.

6. The hang tag of claim 1, wherein the frame, the flap, and the strip are cut out of a uniform sheet of material.

7. The hang tag of claim 1, wherein the strip comprises a visual indicator that indicates a direction in which an end user should pull the strip to remove the strip.

8. The hang tag of claim 1, wherein the frame forms at least one of:
- a substantially triangular shape, a vertex of the triangular shape being at the topmost portion of the frame;
- a substantially ovoid shape;
- a substantially square shape; or
- a hooked shape.

9. The hang tag of claim 1, wherein the hang tag comprises at least one of:
- transparent materials;
- translucent materials;
- opaque materials; or
- colored materials.

10. The hang tag of claim 1, wherein the hang tag comprises at least one of:
- plastic materials;
- metallic materials;
- paper-based materials; or
- laminate materials.

11. A package assembly comprising:
- a package comprising at least a first part and a second part, wherein the first part and the second part are separable; and
- a hang tag comprising:
  - a frame defining an opening dimensioned to receive a fixture for displaying the package, the frame being secured to the first part of the package;
  - a flap coupled to the frame, wherein the flap:
    - is adapted to fold over an edge of the frame and through the opening; and
    - attaches to the second part of the package, thereby forming a seal between the first and second parts of the package; and
  - a strip disposed between, and removably coupled to, the flap and the frame, wherein the seal between the first and second parts of the package is broken when the strip is removed, thereby enabling the first and second parts of the package to be separated.

12. The package assembly of claim 11, wherein removal of the strip transforms the frame of the hang tag into a pull tab that facilitates removal of the first part of the package from the second part of the package.

13. The package assembly of claim 11, further comprising a first adhesive portion that secures the frame to the first part of the package and a second adhesive portion that secures the flap to the second part of the package.

14. The package assembly of claim 11, wherein the first part of the package is dimensioned to be removably inserted into a space defined by the sides of the second part of the package.

15. The package assembly of claim 11, wherein the first part of the package and the second part of the package are dimensioned to enclose a merchandise item.

16. The package assembly of claim 11, wherein the hang tag comprises an indicator that appears on the strip of the hang tag to indicate a direction in which an end user should pull the strip to remove the strip.

17. A method comprising:
- fastening a hang tag to a first part of a package, wherein the hang tag comprises:
  - a frame defining an opening dimensioned to receive a fixture for displaying the package, the frame being dimensioned to be fastened to the first part of the package;
  - a flap coupled to the frame, wherein the flap:
    - is adapted to fold over an edge of the frame and through the opening; and is dimensioned to be fastened to a second part of the package, thereby forming a seal between the first and second parts of the package; and a strip disposed between, and removably coupled to, the flap and the frame, wherein the seal between the first and second parts of the package is broken when the strip is removed, thereby enabling the first and second parts of the package to be separated;

inserting the first part of the package into a space defined by at least one side and bottom of the second part of the package;

folding the flap of the hang tag over an edge of the frame and through the opening; and fastening the flap to the second part of the package, thereby forming a seal between the first and second parts of the package.

18. The method of claim 17, wherein:

the frame comprises a first adhesive portion and the flap comprises a second adhesive portion;

fastening the frame to the first part of the package comprises exposing the first adhesive portion to the first part of the package, thereby forming a seal between the frame and the first part of the package; and fastening the flap to the second part of the package comprises exposing the second adhesive portion to the second part of the package, thereby forming a seal between the flap and the second part of the package.

19. The method of claim 18, wherein:

the hang tag comprises protective barriers coupled to the first and second adhesive portions that prevent the first and second adhesive portions from prematurely adhering to unintended surfaces;

fastening the frame to the first part of the package comprises removing the protective barrier from the first adhesive portion prior to exposing the first adhesive portion to the first part of the package; and fastening the flap to the second part of the package comprises removing the protective barrier from the second adhesive portion prior to exposing the second adhesive portion to the second part of the package.

20. The method of claim 17, wherein the hang tag is manufactured using at least one of:

die-cutting;
molding;
thermoforming;
extruding;
laser cutting;
positive-space printing; or
lamination.

* * * * *